United States Patent [19]

Monroe

[11] 4,362,796

[45] Dec. 7, 1982

[54] PROCESS OF MAKING PHOTOGRAPHIC PRINTS SIMULATING DEPTH AND RESULTANT ARTICLE

[76] Inventor: Robert Monroe, 255 W. 90th St., New York, N.Y. 10024

[21] Appl. No.: 272,552

[22] Filed: Jun. 11, 1981

Related U.S. Application Data

[63] Continuation-in-part of Ser. No. 73,666, Sep. 10, 1979, abandoned, which is a continuation-in-part of Ser. No. 922,821, Jul. 10, 1978, abandoned.

[51] Int. Cl.[3] ..... G03C 7/00; G03C 5/26

[52] U.S. Cl. ..... 430/12; 430/9; 430/367; 430/370; 430/427; 430/430; 430/432

[58] Field of Search ..... 430/9, 16, 12, 950, 430/414, 416, 427, 432, 295, 324, 325, 326, 407, 943, 430, 367, 368, 369, 370, 463; 427/162, 262, 280, 283; 428/29, 30, 208, 913

[56] References Cited

U.S. PATENT DOCUMENTS

| | | | |
|---|---|---|---|
| 242,336 | 5/1881 | Laval | 430/9 |
| 1,802,168 | 4/1931 | Colbert et al. | 430/295 |
| 1,937,146 | 11/1933 | Gries | 430/295 |
| 1,961,335 | 6/1934 | Cheney | 430/295 |
| 1,971,261 | 8/1934 | Harmon | 430/295 |
| 2,083,249 | 6/1937 | Thomson | 430/324 |
| 2,263,149 | 11/1941 | Vargas | 430/14 |
| 2,854,386 | 9/1958 | Lyman | 430/416 |
| 3,110,235 | 11/1963 | Kinnard | 430/12 |
| 3,615,437 | 10/1971 | Richardson | 430/414 |
| 3,822,128 | 7/1974 | Wainer | 430/414 |
| 4,054,453 | 10/1977 | Grobin | 430/524 |
| 4,178,181 | 12/1979 | Sawyer | 430/524 |

FOREIGN PATENT DOCUMENTS

| | | | |
|---|---|---|---|
| 340746 | 3/1932 | Fed. Rep. of Germany | 430/370 |

OTHER PUBLICATIONS

Glatkides, Photographic Chemistry, 1958, pp. 189–199, Chap. XIII, "Toning".

Wall, Photographic Facts & Formula, 1924, pp. 216–248.

Wade, Alternative Photographic Processes, 1978, p. 95.

*Primary Examiner*—Mary F. Downey

*Attorney, Agent, or Firm*—Mark T. Basseches; Paula T. Basseches

[57] ABSTRACT

The present invention relates to a photographic print and process of making the same wherein the print presents highlights by a build-up of high reflective, e.g. specularly reflective, metal in the highlighted areas which would otherwise print as blank or very light-toned areas of exposed paper or film. The gradient areas are preferably defined by spaced, specularly reflective areas optionally interspersed with conventional deposit of particulate silver. The method of fabricating such article includes an initially conventional development step, followed by a second development step wherein the silver halide areas remaining after the first development step are converted into increments of specularly reflective silver. An etching step may be interposed between the conventional development step and the development step leading to the creation of specular areas.

7 Claims, 4 Drawing Figures

FIG. 1
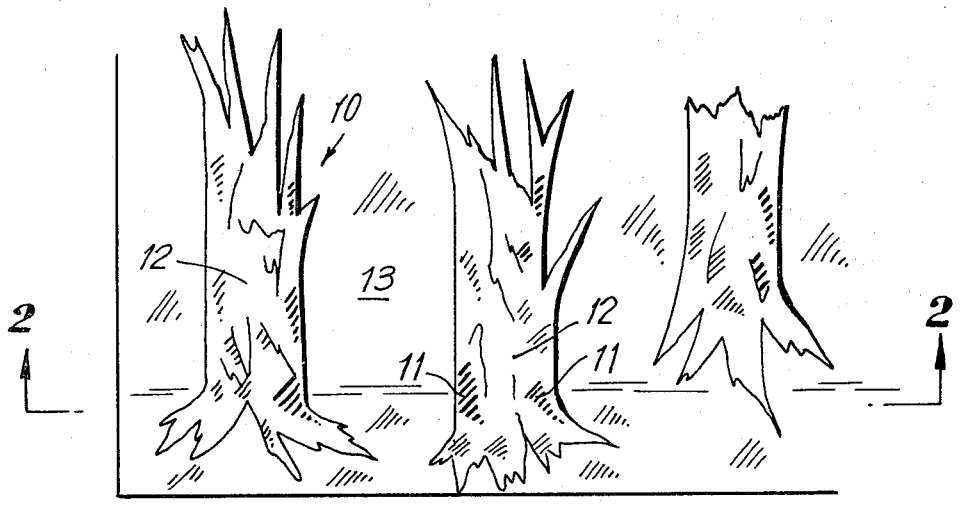
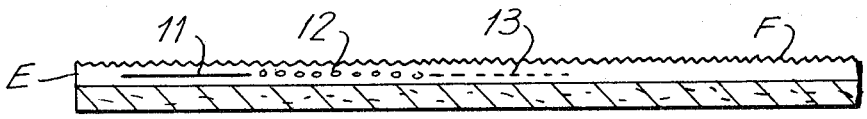
FIG. 2
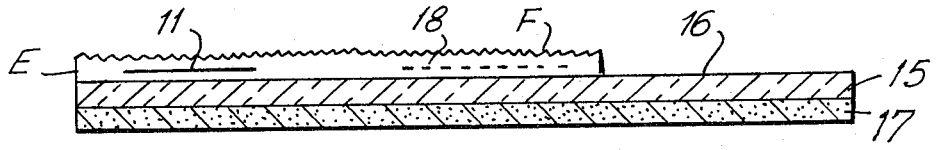
FIG. 3
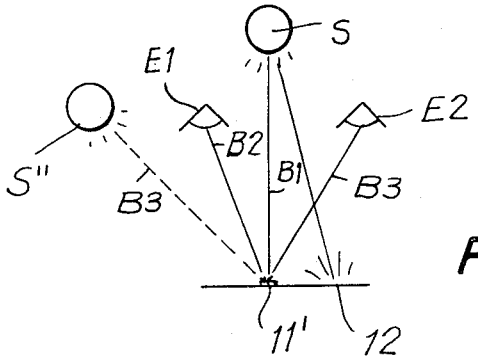
FIG. 4

PROCESS OF MAKING PHOTOGRAPHIC PRINTS SIMULATING DEPTH AND RESULTANT ARTICLE

This application is a continuation-in-part of my application Ser. No. 73,666, filed Sept. 10, 1979, which is in turn a continuation-in-part of my prior application Ser. No. 922,821, filed July 10, 1978, both now abandoned.

BACKGROUND OF THE INVENTION

1. Field of the Invention

The present invention is in the field of photographic images and methods of creating the same, and is directed more particularly to a photographic image which provides the viewer with an illusion of depth, and to the method of making the same.

2. The Prior Art

Various means have been employed to create illusions of depth. In all instances the illusion of depth and the actual perception of depth are occasioned by the fact that the eyes are separated and that the image perceived by one eye is not precisely the same as the image perceived by the other. Means heretofore employed to create the illusion of depth have included stereoscopic viewing apparatus, polarizing or prism-like arrangements covering either the eyes of the viewer or the subject matter viewed, etc., in combination with two differing representations of a given scene, whereby each eye is made to see the scene from a slightly different perspective. Such processes, involving as they do the provision of separate images and mechanism for optically impinging the images in accurate superimposition, involve complex manufacturing and processing steps beyond the purview of the instant description.

No process heretofore known has provided a means forming, by a simple photographic procedure utilizing only a single image, an article having an illusion of depth.

Additionally, no article heretofore known and consisting essentially solely of a single, substantially two dimensional image, has successfully provided a perception of depth.

SUMMARY

The present invention may be summarized as directed to a photographic process for producing from a single image an article providing a sensation or perception of depth.

The present invention may be further summarized as directed to the resultant article.

An appreciation of the depth perception effects achieved from a single image in accordance with the present invention is best understood in the context of the limitations of conventionally produced photographic images.

Such images comprise an emulsion within which have been deposited closely spaced particles of precipitated colloidal silver. In the areas of greatest silver concentration, corresponding to shadow areas, a black (or, if toned, a dense colored) image is formed. In the highlight areas, where little or no particulate silver exists, the viewer will perceive the backing material beneath the transparent emulsion, normally white. In the areas where intermediate quantities of particulate silver are precipitated, the viewer will perceive a grayish color since intermediate quantities of light are reflected from the diffuse surface carrying the emulsion.

As will be appreciated from the foregoing, the maximum reflectivity of a conventional print or film, e.g. the areas of highlight, and the minimum areas of reflectivity, e.g. shadow, provide a relatively restricted dynamic range as compared to actual scenes that are the subject of the photograph. The luminance of actual scenes may range from very low levels in the scotopic range (less than 10 cd/m$^2$) to very high luminance in the photopic range (as great as 10,000 cd/m$^2$). No known photographic process can remotely approach the dynamic range noted.

I have discovered that a photographic procedure in accordance with that hereinbelow described provides an illusion of depth which is considered to result from the production of a photographic print on paper or film wherein the dynamic range perceived far exceeds that of photographic images heretofore known. Moreover, and importantly, the dynamic range perceived by one eye differs from that perceived by the other eye, which difference provides an illusion of depth.

In contrast, the eyes viewing a conventional photographic image perceive essentially identical images, whereby no depth effect results.

The wide dynamic range and the disparate images impinged on the eye result from creating a photographic image having specularly reflective or mirror film areas corresponding to the highlight areas, substantially non-reflective areas corresponding to the shadow areas, and gradient areas of intermediate or no reflectivity which may include small spaced specularly reflective areas, or areas of dichroic silver.

When a photographic image as described is viewed in reflected light, and especially where such light is essentially in a beam rather than diffuse, a given area of the image may reflect to one eye a drastically greater amount of light than is reflected to the other eye by the same portion of the print. Such effect, combined with the fact that the dynamic range obtainable by providing specularly reflective areas and non-reflective areas (gradients) uniquely enables the production of a photographic image giving the impression of depth. A further factor contributing to the impression of depth is the textural gradients resulting from contasts perceived between the smooth specularly reflective areas on the one hand and the matte surface of the image on the other.

The process for forming the unique photographic image hereinabove described includes providing a backing carrying an emulsion incorporating silver halides, exposing the emulsion through an actinic ray permeable member, such as a photographic negative, and developing the exposed film or paper in conventional manner. The thus partially completed image is thereafter subjected to a developing bath as hereinafter described which functions to reduce the remaining areas of silver halide (corresponding to the highlight areas and the non-precipitated areas in the intermediate exposed portions of the emulsion) in such manner as to produce of such halides specularly reflective areas of silver.

It should be noted that the specularly reflective areas are produced in situ, i.e. are formed of the silver halides within the emulsion not precipitated as a result of the initial conventional developing step.

As a variation of the noted procedure, an etching step may be interposed between the conventional developing step and the step used to provide specularly reflective components whereby the initially precipitated silver is removed.

It is accordingly an object of the present invention to provide a photographic image evoking in the viewer a perception of depth.

A further object of the invention is the provision of a photographic image of the type described wherein, due to the highly reflective nature of certain of the components of the image, each eye of the viewer will receive a different quantity of light from a given point on the image, whereby the same image will be perceived differently by the respective eyes of the viewer to create an illusion of depth or stereopsis.

A further object of the invention is the provision of a photographic image which provides both luminance and textural gradients.

A still further object of the invention is the provision of a method for manufacturing a device of the type described.

As will be understood by those skilled in the art, to achieve an apparent depth perception the subject matter must be of a nature which lends itself to such effect, i.e. one which the mind would expect to evidence a depthwise impression when viewed in nature.

To attain these objects and such further objects as may appear herein or be hereinafter pointed out, reference is made to the accompanying drawings, forming a part hereof, in which:

FIG. 1 is a schematic view of a portion of a scene which lends itself to the depth perception qualities of the present invention.

FIG. 2 is a schematic or diagrammatic cross-sectional view of a small portion of the print of FIG. 1;

FIG. 4 is a schematic view illustrating the optical effects on the eyes of a viewer observing a print in accordance with the invention;

FIG. 3 is a schematic view similar to FIG. 2 of an embodiment of the invention.

Referring to the drawings, the print of FIG. 1 has a plurality of highlighted areas 10 in which the texture of the bark is highlighted by portions reflecting more light, (i.e. having greater radiance or luminance), while the lower portions are perceived as relatively non-reflective and are dark.

In accordance with an article of the present invention, the highlights are caused by the formation of specularly reflecting silver in the areas where the highlights are to occur, and this build-up of specularly reflective silver in the sections 11, 11 within emulsion E contrasts with the shadows in the section 12, which are comprised of particulate, colloidal or non-reflective silver or, in accordance with a modification of the invention, areas free of silver through which a dark opaque backing may be seen.

The areas 13 may comprise areas of intermediate silver build-up (gradient areas).

The differential effects on the eyes of a viewer of the image in accordance with the illustrated embodiment are diagrammatically shown in FIG. 4. In such figure, E1, E2 represent the eyes of the viewer which, as is known, have an inter-ocular distance of about three inches. S is a light source.

As will be seen from FIG. 4, a light beam B1 emitted by the source S and incident on point 11' will be reflected back to eye E1 along beam path B2, wherefor the spot or area of impingement of the beam B1 on eye E1 will appear to be extremely bright.

As will be further apparent, the beam B3 impinging upon eye E2 from point 11' will be of far less intensity since the light source S'' emitting the beam B3 is an ambient light source other than the principal source S. The point 11' of FIG. 4 will thus be perceived as far brighter by eye E1 than by eye E2.

It will, however, be readily recognized that if the image is tilted, e.g. in a clockwise direction as perceived in FIG. 4, the light beam emanating from source S and reflected by specularly reflective highlight point 11 may be more strongly perceived by eye E2 than by eye E1. The depth effect thus varies in accordance with the oriented position of the image relative to the eyes and the oriented position of the light source relative to the image and the eyes.

It will be observed that since depth perception effects depend in large measure on the contrast between specularly reflective and non-reflective portions of the image, the use of a highly glossy paper or film surface is counter-indicated, a highly matte or textured facing surface F on emulsion E being preferred.

The procedures for forming the image will now be described in greater detail.

FOR PRINTING ON PAPER

A conventional matte photographic paper, such as, by way of example, a Kodalith Standard Ortho printing paper, is exposed to actinic light passed through a photographic negative or the like in conventional manner. As is well known, the negative will typically include dark areas corresponding to highlights in the photographed scene, light areas corresponding to shadow areas of the photographed scene, and gradient areas therebetween.

The exposed paper is then developed in any standard print developer, such as Kodalith developer, at normal developing temperatures, usually between 60° to 75° F. The exposure and development procedures are, of course, carried out under darkroom conditions.

The print may now be subjected to a stop bath, such as a weak acetic acid, or may be directly immersed in the silver reducing developer next to be described.

As will be understood by those skilled in the art, the first developing procedure has resulted in the formation of an essentially conventional print by reducing the silver halides in the areas exposed to actinic energy to spaced, finely divided colloidal silver particles. The greater the exposure to actinic energy, the greater the concentration of silver halides converted to colloidal silver and, hence, the darker the image. It will be further recognized that those areas of the print which were not exposed to actinic energy will retain in the emulsion E concentrated areas of silver halide.

It is the function of the silvering reducer to convert the remaining silver halides into specularly reflective surfaces. This function is achieved by two simultaneously occurring actions of the silvering reducer, notably dissolving out the halides and converting the same in situ into specularly reflective silver as the same pass into solution. The theoretical basis whereby a specularly reflective film is created, as opposition to a colloidal or dark appearing silver deposit as formed by conventional development techniques is not fully understood. It is believed, however, that this result flows from the simultaneously occurring reactions of the ammonia which causes the halide to go into solution and the hydrazine sulfate which converts the halide to silver precisely as it is dissolved.

Such silvering reducers are known per se, one such formula being sold under the name Rockland Halo Chrome Mirror Developer, sold by Rockland Colloid Corp. of Piermont, New York. Such material is comprised of the following ingredients:
sodium sulphite 1 gram
hydrazine sulfate 2 grams
sodium hydroxide 2 grams
ammonium hydroxide (28% ammonia) 5 cc
water 100 cc.

An alternate silvering reducer formula is as follows:
sodium sulphite 100 grams
sodium hydroxide 100 grams
hydrazine sulfate 30 grams
phenol 40 grams
butyl alcohol 12 cc
ammonium hydroxide (28% ammonia) 500 cc
water to make 2000 cc solution To the above add a quantity of phenosafrinin solution (1 part to 1000 parts water) until the mixture is a light pink color. Other known photographic reducers may be substituted for the hydrazine sulfate with suitable adjustment of the formula. Other ammonical silvering reducers may be formulated utilizing sodium formate, glyoxal and Rochelle salts.

The print is immersed in the silvering reducer until the desired metal build-up is achieved. Normally the prints will be left in solution for a time sufficient to reduce all of the remaining silver halides to silver. Where the silver is totally precipitated (by the first and second developing steps), the print need not be subjected to conventional fixing steps (hypo). Where the development in the silvering developer is continued short of complete precipitation of the silver from the halides, the prints should be subjected to a stop bath, fixed, and washed to remove hypo.

The effect of the silvering reducer is to produce highlight areas of reflective and apparently continuous silver films, e.g. mirror-like surfaces.

In the shadow areas formed of colloidal silver, of course, the silvering developer will have substantially no effect.

The gradient areas are somewhat reflective, dependent upon the concentration of halides acted upon by the silvering reducer. Such areas evince a slightly brownish cast and are believed to comprise a mixture of colloidal silver precipitated by the conventional developer and flakes or increments of dichroic silver, i.e. platelets of silver film too thin to be truly reflective.

PRINTING ON FILM

Where the procedure is to be employed in conjunction with a transparent film substrate carrying the halide containing emulsion, an etching procedure is preferably interposed between the first developing step and the silvering developing step.

More particularly, and with reference to FIG. 3, the film 15 having an upper surface 16 emerging from the first developer, and preferably also a stop bath, is immersed in an etching solution, well known per se and, by way of example, as follows:

Solution A cupric chloride 10 grams
citric acid 10 grams
water to make 1 gallon.

Solution B

3% hydrogen peroxide
Just prior to use, mix equals parts of Solutions A and B.

The etching solution functions to remove the particulate silver precipitated in the conventional developing step while leaving the halide containing portions of the emulsion intact. The etchant may also loosen those portions of the emulsion in registry with the precipitated silver, in which case the emulsion is washed to remove the loosened portions.

The resultant article is next immersed in the silvering developer as before, whereby the halide areas are converted into specularly reflecting silver 11, as hereinabove described.

Since the depth effect is perceived as a result of reflected light, the resultant image should be backed by an opaque, preferably relatively non-reflective surface 17, such as a black or dark blue backing paper. The areas 18 represent portions in which the halides remaining after the first development step have been precipitated to form more or less reflective areas, depending upon concentration.

If desired, color may be achieved by toning the fused silver surfaces of the paper backed emulsion or the film backed emulsion, e.g. in a ferricyanide reducer and hardening in an acetic bath, and utilizing a preservative such as ethyl alcohol. A suitable toning bath may comprise:
potassium ferricyanide 1 oz.
potassium bromide 1 oz.
sodium chloride 1 oz.
Add water to make one quart.

As will be perceived from the preceding description, there is provided a method and process for making a photographic image providing a perception of depth. Numerous variations in starting materials and processing reagents may be made without departing from the spirit of the invention and, accordingly, the same is not to be construed as limited to the use of the specific papers, developers, etchants, toners, etc.

By way of example, a wide variety of photographic papers or films may be suitably employed, with the proviso above noted that matte finishes are to be employed, and that the halide concentration is sufficient to evince a reflective effect when processed by the silvering reducer. The suitability of a given film or paper from the latter standpoint may be readily established by immersing an unexposed sample in the silvering reducer.

Other reagents capable of reducing sufficiently high concentrations of halide to specularly reflective areas of silver may be suitably substituted for the disclosed formulations, which are included by way of example and not limitation.

As noted, the processes described result in the production of articles having gradients of two different types, namely gradients of texture between the smooth silver layer and the matte surface, and gradients of light perception between the highly reflective silver surface and the dark colored backing sheet or the shadow areas of black precipitated silver.

Accordingly, the invention is to be broadly construed within the scope of the appended claims.

Having thus described the invention and illustrated its use, what is claimed as new and is desired to be secured by Letters Patent is:

1. The method of making a photographic reproduction which provides an illusion of depth which comprises the steps of providing a film which includes a transparent backing and a silver halide containing emulsion having a textured facing surface, exposing said emulsion to a source of actinic energy through an energy transmitting medium having superposed areas of energy blocking, energy transmitting and partial energy transmitting material, subjecting said exposed emulsion to a developer solution, thus to reduce the halides in said emulsion to colloidal silver in proportion to the amount of actinic energy received thereon, and thereafter subjecting said partially developed emulsion to an ammoniacal silvering reducer bath formulated to produce a mirror surface of pure silver in situ in areas of unreduced silver halide.

2. The method in accordance with claim 1 and including the step of subjecting said partially developed film to an etch bath partially to remove the colloidal silver precipitated by said developing step in advance of placing said film in said silvering reducer bath.

3. The method in accordance with claim 1 and including the step of mounting said reproduction on an opaque, substantially non-reflective backing member.

4. The product produced by the process in accordance with claim 1.

5. The product produced by the process in accordance with claim 2.

6. The product produced by the process in accordance with claim 3.

7. The process of making a photographic reproduction for the purpose of stimulating depth perception and for producing a reproduction having areas of highly reflective radiant surfaces having the capacity for radiance at varying light intensities and for producing textural surfaces which define the original subject matter as a texture gradient plus the combination of gradients and texture which allow for variations in perception in response to variations in angular relations among the light source, the viewer and the reproduction, said process consisting of the steps of exposing a silver sensitized sheet material on a transparent backing to light passing through light transmitting material having a plurality of coated light blocking areas defined by a plurality of light transmitting areas which are respectively related to various portions of the scene which the reproduction is intended to reproduce, developing said reproduction until an image appears, introducing said image bearing reproduction into an etch bath partially to remove the colloidal silver precipitated by said developing step, and thereafter inserting said developed and etched reproduction into an ammoniacal silvering reducer bath capable of converting substantially unexposed areas of said sheet to pure mirror reflective silver.

* * * * *